United States Patent [19]

Marder et al.

[11] 4,398,970

[45] Aug. 16, 1983

[54] TITANIUM AND VANADIUM DUAL-PHASE STEEL AND METHOD OF MANUFACTURE

[75] Inventors: Arnold R. Marder; Bruce L. Bramfitt, both of Bethlehem, Pa.

[73] Assignee: Bethlehem Steel Corporation, Bethlehem, Pa.

[21] Appl. No.: 308,686

[22] Filed: Oct. 5, 1981

[51] Int. Cl.[3] ..... C21D 8/00; C22C 38/12

[52] U.S. Cl. ..... 148/12 F; 148/12.4; 148/36

[58] Field of Search ..... 148/12 F, 36, 12.4, 148/12 C, 134; 75/123 M

[56] References Cited

U.S. PATENT DOCUMENTS

| | | | |
|---|---|---|---|
| 4,033,789 | 7/1977 | Hamburg et al. | 148/12 F |
| 4,325,751 | 4/1982 | Josefsson | 148/12 F |
| 4,331,488 | 5/1982 | Sudo et al. | 148/36 |

FOREIGN PATENT DOCUMENTS

| | | | |
|---|---|---|---|
| 51-39524 | 4/1976 | Japan | 148/12.3 |
| 55-152128 | 11/1980 | Japan | 148/12.4 |

*Primary Examiner*—Peter K. Skiff

*Attorney, Agent, or Firm*—John I. Iverson; William B. Noll

[57] ABSTRACT

This invention is directed to a method and to the resulting product, wherein said product is a low-carbon dual phase steel having a combination of high strength, good ductility and a YS/TS ratio ≦0.6. The method includes the steps of (1) preparing an Al-killed steel consisting essentially of 0.05 to 0.15 wt. % C, up to 2.0 wt. % Mn, up to 1.0 wt. % Si, 0.03 to 0.15 wt. % V and a sufficient amount of titanium to "getter" the excess sulfur and nitrogen, with the balance essentially being iron, where the titanium addition should be at least equal to the atomic percent of the sulfur plus nitrogen, but no more than about 1.6 times, (2) intercritically annealing such steel within the $\alpha+\gamma$ temperature range, and (3) cooling to room temperature.

6 Claims, 1 Drawing Figure

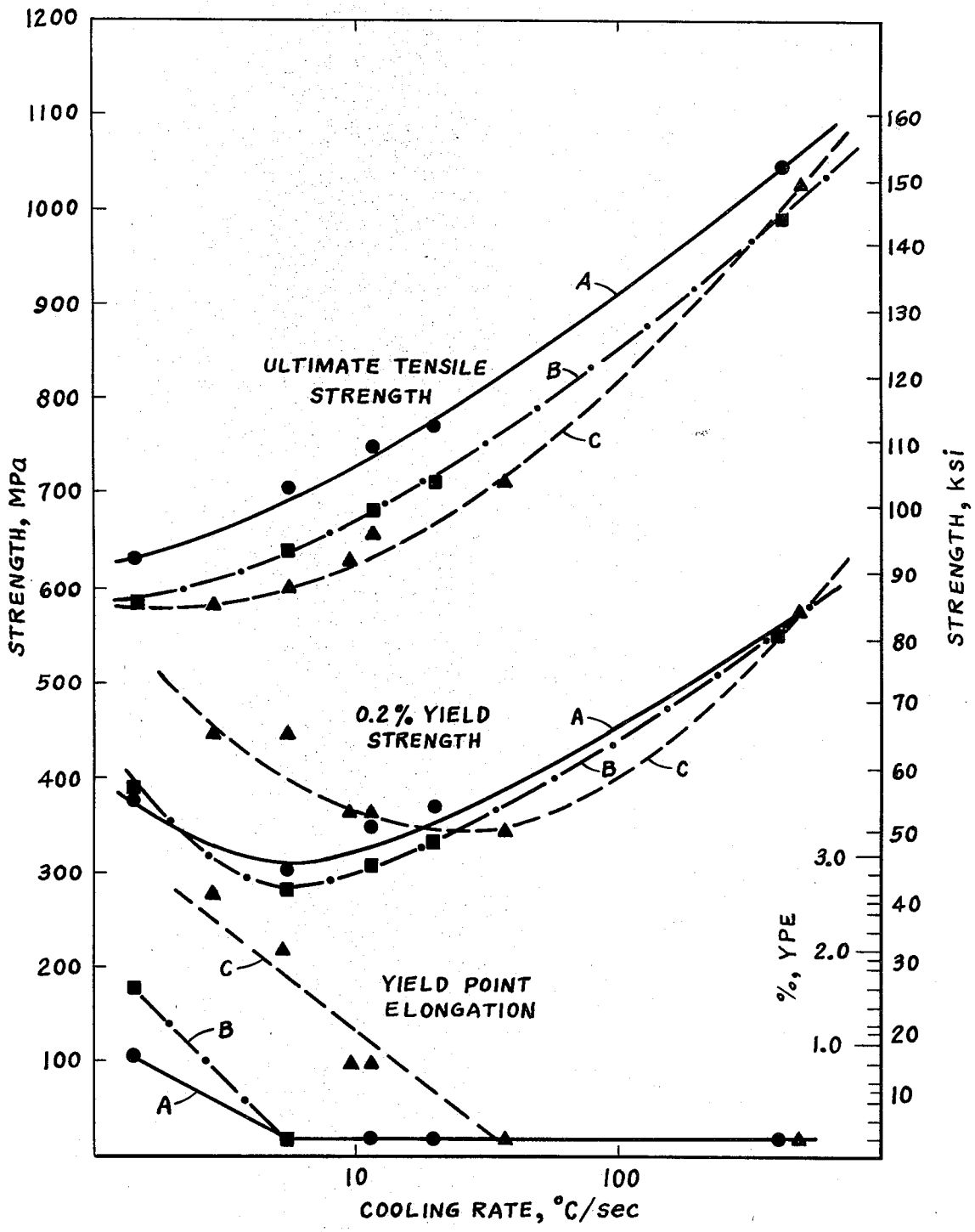
1200
1100
1000
900
800
700
600
500
400
300
200
100
STRENGTH, MPa
160
150
140
130
120
110
100
90
80
70
60
50
40
30
20
10
STRENGTH, ksi
3.0
2.0
1.0
%, YPE
ULTIMATE TENSILE STRENGTH
0.2% YIELD STRENGTH
YIELD POINT ELONGATION
A
B
C
10
100
COOLING RATE, °C/sec

TITANIUM AND VANADIUM DUAL-PHASE STEEL AND METHOD OF MANUFACTURE

BACKGROUND OF THE INVENTION

In recent years considerable interest has been generated throughout the world in formable, high strength dual-phase sheet steel. The present invention is directed to such a type of steel. "Dual-Phase" sheet steels, introduced in the 1970's, offer the unusual combination of good formability and weldability in a steel of high tensile strength. The good formability is due to a low YS/TS ratio, a high work hardening rate which exists through to very high strains, and the high fracture strain. This combination of strength with formability and weldability is important, particularly to the automotive industry. Such combination offers the opportunity to the autobody fabricator to produce lighter parts while maintaining sufficient strength in such parts.

Microstructurally, dual-phase steels consist of a fine-grained equiaxed ferrite containing a coarse dispersion of a hard phase such as martensite or bainite. The steels can be produced by a number of different processes: (1) as-rolled, (2) batch-annealed, and (3) continuous-annealed in which the steel is annealed for a short time in the intercritical temperature range, rollowed by rapid cooling to transform the austenite to martensite/upper bainite.

Because of the strong interest in dual-phase steels, due in large measure to their very desirable properties, there is considerable published information on dual-phase steels. U.S. Pat. Nos. 4,222,796 (Davies), 4,129,461 (Rashid) and 4,033,789 (Hamburg et al) are exemplary of such publications and indicate the direction the art has taken on dual-phase steels.

The Davies patent discloses a method of making a dual-phase steel by adding 0.1–0.2% Mo to 0.3–0.5% Cr and/or 0.07–0.2% V, by weight, to a Mn—C steel, heating such steel to an intercritical annealing range of 740°–830° C. (1364°–1526° F.) for several minutes, and cooling at a rate less then 100° C./sec (180° F./sec).

Rashid, in his patent, presents some of the earliest work on the development of dual-phase steels. The patent is directed to a process for improving the formability of commercial HSLA steels, such as SAE 980X, which are essentially microalloyed low-carbon steels containing various additions from the group of carbide, nitride, and carbonitride formers, such as Ti, V, Cb. In the process, a steel of this type is heated to at least the lowermost eutectoid temperature of the steel for a time sufficient to at least partially transform the microstructure of the steel to austenite and to dissolve a substantial proportion of the microalloying additions into the austenite without appreciable grain growth and then cooling said steel to substantially lower the yield strength and improve the formability of the steel while maintaining its tensile strength. As a final step, the thus cooled steel is plastically deformed by an amount equivalent to at least 2% strain on the tensile stress-strain diagram for such a steel, to substantially increase the yield strength after the plastic deformation.

The Hamburg et al patent is directed to a method of heat treating a steel to improve its strength and formability. The process includes the steps of austenitizing a steel consisting essentially of from 0.04 to 0.17% carbon, 0.8 to 2.0% manganese, up to 1.0% silicon, up to 0.12% vanadium, up to 0.1% columbium, up to an effective amount of titanium to form titanium carbonitrides, 0.001 to 0.025% nitrogen, balance iron to a temperature above the $Ac_3$ temperature of the steel. Thereafter, the steel is cooled at a rate of no more than about 70° F./sec to about 850° F., then further cooled at a rate of more than about 10° F./sec. Such steel is characterized by a minimum ultimate tensile strength of 80,000 psi, a minimum tensile uniform elongation of 16%, and a microstructure of from about 10% to 35% MLB (martensite/lower bainite), balance essentially proeutectoid ferrite.

The disclosure of the present invention represents a further addition to the family of dual-phase steels that through the balancing of the steel's chemistry permits better or tighter control of the strength/ducility relationship. This balancing and the effects thereof will become more apparent from the specifications which follow.

SUMMARY OF THE INVENTION

The present invention relates to a product and to the production of a dual-phase steel that is less dependent on processing variables than is typical with the production of existing prior-art dual-phase steels. The steel is characterized by a combination of high strength, good ductility, and a YS/TS ratio $\leqq 0.6$. Chemically, the steel is a low-carbon Al-killed steel consisting essentially of the following, by weight:

C—0.05 to 0.15%
Mn—2.0% max.
Si—1.0% max.
V—0.15% max.
Al—0.02 to 0.06%
S—0.020% max.
N—0.010% max.
Ti—an amount sufficient to "getter," or combine with, excess sulfur and nitrogen, typically between about 0.02 to 0.11%,
Fe—balance.

The method includes the steps of preparing a steel having a chemistry balanced as above, intercritically annealing such steel within the $\alpha+\gamma$ temperature range, and cooling to room temperature at a rate which may be as low as 5° C./sec.

BRIEF DESCRIPTION OF DRAWINGS

The FIGURE is a plot of mechanical properties versus cooling rates from the intercritical annealing temperature, contrasting the properties of the steel of this invention (A) with the properties of two single-alloyed steels (B and C).

DESCRIPTION OF PREFERRED EMBODIMENT

The present invention is directed to a low-carbon dual-phase steel having a combination of high strength, good ductility, and a YS/TS ratio $\leqq 0.6$ produced by intercritically annealing within the $\alpha+\gamma$ temperature range and cooling to room temperature, where such cooling may be at a rate as low as 5° C./sec. Dual-phase steels are characterized by a ferrite plus martensite structure with occasional amounts of austenite. The ferrite is essential and must be void of fine precipitates for optimum ductility. Because of the stresses associated with the martensite, the ferrite contains an inhomogeneous distribution of dislocations. As a result of this structure, these dual-phase steels exhibit continuous yielding and therefore a YS/TS ratio of less than about 0.6. Thus, by definition, a dual-phase steel is one which when suitably processed will be characterized by a YS/TS ratio of ≦0.6.

Vanadium, when present in a dual-phase steel, is known to increase the hardenability of the austenite phase during intercritical annealing and therefore improve the ability of the steel to form martensite over a greater range of cooling rates from the intercritical temperature range than is possible with comparable steels without vanadium. It was discovered, contrary to the teachings of the prior art, such as U.S. Pat. No. 4,129,461, that vanadium and titanium are not interchangeable or functional equivalents as additions for dual-phase steels. Rather, it was discovered that critically controlled amounts of titanium to a vanadium-bearing dual-phase steel can further improve the properties of the steel.

To demonstrate the significance of the addition of both vanadium and titanium to a dual-phase steel, a series of steels containing vanadium and/or titanium was prepared. TABLE I lists the chemistry for such steels.

TABLE I

| Dual-Phase Steel | C | Mn | Si | V | Ti | S | N | Al | Ti + V |
|---|---|---|---|---|---|---|---|---|---|
| A | .10 | 1.53 | .68 | .048 | .046 | .007 | .012 | .007 | .094 |
| B | .098 | 1.45 | .58 | .075 | .006 | .002 | .012 | .002 | .081 |
| C | .14 | 1.50 | .55 | .003 | .095 | .012 | .011 | .012 | .098 |

All such steels were subjected to an intercritical annealing temperature of 816° C. for one minute at temperature and cooled at various rates to room temperature. The properties of ultimate tensile strength, 0.2% yield strength, and yield point elongation for each steel are plotted in the FIGURE against various cooling rates. Even though an approximate equivalent total amount of microalloying additions, i.e. Ti+V, was used, the T.S. and Y.S. of the steel of this invention (A) were consistently higher than steels B and C containing either vanadium or titanium.

A significant feature of this data is that the titanium-containing steel (C) has a high critical cooling rate, about 40° C./sec., as determined by the minimum in the plot of yield strength versus cooling rate. At slower cooling rates, continuous yielding, which from the above it will be recalled is a characteristic of dual-phase steels, gives way to discontinuous yielding and a yield point elongation. Thus, at cooling rates of less than about 40° C./sec., steel C would not exhibit dual-phase properties. Steels A and B exhibited similar critical cooling rates on the order of about 5° C./sec. Flexibility in the rate of cooling is a significant processing variable. The use of rather slow cooling rates, on the order of 5° to 10° C./sec., avoids the buildup of stresses and distortion in the steel that are associated with the more rapid cooling rates. Also, these slower cooling rates allow for easier commercial processing, i.e., air cooling rather than accelerated cooling. That is, the slower cooling permits a degree of thermal recovery not available to the steels cooled at the higher rates, i.e., in excess of 40° C./sec.

Finally, in a comparison of steel A with steel B, steel A exhibited a higher T.S., on the order of 6 to 7 ksi.

It will be recalled that a feature of this invention is the critical balancing of the elements V and Ti. To understand this balancing, further explanation on the role of Ti and V in low-carbon steels of the type discussed above is needed.

It is known, for example, that under proper conditions both V and Ti can form carbonitride precipitates in such steels. However, only the Ti will form nitrides in the melt. Ti will also form sulfides and oxides. However, the oxygen is primarily combined with the deliberately added Al, about 0.02 to 0.06% by weight, in the killing, or deoxidation, process. It is also known that titanium carbide and nitride precipitates are not soluble at the intercritical annealing temperatures, namely about 760°–830° C. Therefore, by reference to the three steels above, in steel C, both the Ti and the C are tied up. As a consequence, neither Ti nor C is available to improve the hardenability of the austenite. In contrast, in steel B it can be expected that vanadium carbides will dissolve or at least partially dissolve in the austenite at the intercritical annealing temperatures. However, a sufficient amount of V and C will be available in the austenite to enhance hardenability. In the case of steel B, approximately 0.043% V is necessary to "getter" the N while the remaining 0.032% V will be available to go into the solution in the austenite pools at the intercritical annealing temperatures. For purposes of this specification, "getter" means to tie up an element as a compound, e.g., VN, TiN, etc. The calculations are based on the atomic percent of the element, such as Ti, to form such compound.

For steel A, the Ti initially forms sulfides and nitrides in the melt so that the V is free to enhance hardenability. Approximately all of the 0.046% Ti contained in the overall composition is needed to tie up the nitrogen and sulfur alone, thereby allowing all the V to be used for hardenability. Thus, as a minimum, Ti should be present in an amount such that its atomic percent is equal to the atomic percent of S plus N. However, even though the Al present in the steel should be sufficient to tie up the oxygen, some Ti may be lost to deoxidation. Therefore, some Ti, over and above that necessary to "getter" S and N, may be used. However, the excess should not exceed more than about 60%, preferably no more than about 40%, of that needed to "getter" the S and N. With titanium present in an amount above about 60% of that which is needed, problems can occur. In this regard, a second V—Ti—bearing steel was prepared and processed in a manner similar to that for steels A to C. The composition for said V—Ti bearing steel consisted of the following, by weight:

C—0.11%
Mn—1.45%
Si—0.59%
P—0.015%
S—0.014%
N—0.005%
Al—0.039%
V—0.11%
Ti—0.12%
Fe—balance.

For such steel, the atomic percent of Ti was 0.18%, while the atomic percent for S (0.022%) and N (0.02%) totaled 0.042%. Thus, the Ti addition far exceeded that which was needed to "getter" the S and N in the melt; in fact, it was more than 329% of that which was needed, or the a/o Ti was 4.29 times the a/o S plus a/o N. As a consequence, the excess Ti formed TiC precipitates. Formation of these precipitates resulted in less carbon being available during the intercritical anneal to enhance the hardenability of the austenite pools (TiC is not soluble at these temperatures). As a result, dual-phase properties were not obtained: 0.2% YS at 524 MPa (75.7 ksi), strength at 3% strain at only 549 MPa (79.7 ksi), UTS at 654 MPa (94.5 ksi), total elongation at 25.5%, and a YS/TS=0.8. In fact, this Ti-V steel had properties similar to those expected for a conventional HSLA micro-alloyed steel.

According to the present invention, as demonstrated by the four exemplary steels described above, the chemistry of the steel must be carefully balanced to achieve the dual-phase properties of high strength, good ductility, and a YS/TS ratio ≦0.6. Specifically, the chemistry, in its broadest and most preferred form, must be balanced within the following ranges, by weight percent:

| Broad(1) | | Preferred(2) |
|---|---|---|
| 0.05–0.15 | C | 0.07–0.12 |
| up to 2.0 | Mn | 0.50–1.60 |
| up to 1.0 | Si | 0.30–0.70 |
| 0.03–0.15 | V | 0.04–0.10 |
| 0.02–0.11 | Ti | 0.03–0.08 |
| up to 0.020 | P | up to 0.015 |
| up to 0.020 | S | up to 0.015 |
| up to 0.008 | N | up to 0.008 |
| 0.02–0.06 | Al | 0.02–0.06 |
| balance | Fe | balance |

where:
(1)a/o[S + N] ≦ a/o[Ti] ≦ 1.6 a/o[S + N]
(2)a/o[S + N] ≦ a/o[Ti] ≦ 1.4 a/o[S + N]

A dual-phase steel, chemically balanced as above and processed in the preferred manner described hereinafter, will possess a microstructure consisting principally of martensite within a matrix of fine-grained ferrite.

Briefly, in the practice of the method of this invention, Dual-Phase Steel A (TABLE I) was melted following conventional steelmaking practices and formed into an ingot. The ingot was heated to a temperature of about 1250° C. and soaked for 2¾ hours. The fully soaked ingot was then subjected to an initial rolling, i.e., roughing with an exit temperature in the range of 1120°–1150° C., and a final rolling to sheet thickness. The finishing temperature off the hot mill was 900°–930° C. and the strip was coiled at temperature of about 565°–590° C. The mechanical properties of steel A off the hot mill were as follows:

0.2% YS=538 MPa
UTS=681 MPa
Total Elong.=24%

To demonstrate the suitability of such steel to develop dual-phase properties after annealing and cooling, a number of hot-rolled samples of Steel A were subjected to an intercritical anneal ($\alpha+\gamma$temperature region) at 816° C. for one minute at temperature. The several samples were then cooled at various cooling rates from less than about 1° C./sec. to about 600° C./sec. As shown in the FIGURE, bottom curve, it was possible to secure dual-phase properties with cooling rates as low as 5° C./sec. This capability is particularly significant because it improves the flexibility of commercial processing of dual-phase steels.

We claim:

1. A high-strength dual-phase steel consisting essentially of, by weight 0.07–0.12% carbon, 0.50–1.60% manganese, 0.30–0.70% silicon, up to 0.020% phosphorus, up to 0.020% sulfur, up to 0.008% nitrogen 0.02–0.06% aluminum, 0.03–0.15% vanadium, 0.02–0.11% titanium, provided that the atomic percent of titanium is between 1 and 1.6 times the atomic percent of sulfur plus nitrogen, balance iron, said steel being characterized by a YS/TS ratio ≦0.6.

2. The dual-phase steel according to claim 1, in which the atomic percent of titanium is no more than 1.4 times the atomic percent of sulfur plus nitrogen.

3. The dual-phase steel according to either one of claims 1 or 2, in which vanadium is present in an amount between 0.03 and 0.10% and titanium is present in an amount between 0.03 and 0.08%.

4. A method of producing a dual-phase steel possessing high strength, good ductility, and a YS/TS ratio ≦0.6, comprising the steps of preparing a chemically balanced ferrous alloy consisting essentially of the following, by weight:

C—0.07 to 0.12%
Mn—0.50 to 1.60%
Si—0.30 to 0.70%
V—0.15% max.
Al—0.02 to 0.06%
S—0.020% max.
N—0.010% max.
Ti—0.02 to 0.11%
Fe—balance, where: a/o≦a/o<1.6 a/o, processing said alloy by hot rolling to a predetermined thickness, annealing said alloy within the austenite plus ferrite temperature range, and cooling said alloy at the rate of at least 5° C./second to transform the austenite to martensite to reveal a microstructure consisting principally of martensite within a matrix of fine-grained ferrite.

5. The method according to claim 4, in which a/o≦a/o≦1.4 a/o.

6. The method according to either one of claims 4 or 5, in which vanadium is present in an amount between 0.03 and 0.10% and titanium is present in an amount between 0.03 and 0.08%.

* * * * *